US009745942B2

(12) United States Patent
Flick et al.

(10) Patent No.: US 9,745,942 B2
(45) Date of Patent: Aug. 29, 2017

(54) REMOTE START SYSTEM INCLUDING TEMPERATURE BASED ENGINE STOPPAGE AND RELATED METHODS

(71) Applicant: Omega Patents, L.L.C., Douglasville, GA (US)

(72) Inventors: Kenneth E. Flick, Douglasville, GA (US); Martin Tessier, ST Leonard (CA); Patrick Noel, ST Leonard (CA); Jean-Pierre Aubertin, ST Leonard (CA); Duc Minh Cong Nguyen, ST Leonard (CA); Cristinel Zaharia, ST Leonard (CA)

(73) Assignee: OMEGA PATENTS, L.L.C., Douglasville, GA (US)

( * ) Notice: Subject to any disclaimer, the term of this patent is extended or adjusted under 35 U.S.C. 154(b) by 780 days.

(21) Appl. No.: 13/834,757

(22) Filed: Mar. 15, 2013

(65) Prior Publication Data

US 2014/0277839 A1 Sep. 18, 2014

(51) Int. Cl.
*F02N 11/08* (2006.01)

(52) U.S. Cl.
CPC .. *F02N 11/0807* (2013.01); *F02N 2200/0804* (2013.01); *F02N 2200/122* (2013.01)

(58) Field of Classification Search
None
See application file for complete search history.

(56) References Cited

U.S. PATENT DOCUMENTS 4,381,042 A 4/1983 Perry
5,219,413 A 6/1993 Lineberger
5,719,551 A 2/1998 Flick
6,011,460 A 1/2000 Flick
6,812,829 B1 * 11/2004 Flick ..... 340/426.13
7,310,576 B1 12/2007 Letang
7,369,936 B2 * 5/2008 Flick ..... 701/113
8,154,251 B2 * 4/2012 Oakes ..... 320/132
(Continued)

FOREIGN PATENT DOCUMENTS

JP 2000097138 A * 4/2000

OTHER PUBLICATIONS

Machine translation of JP 2000097138 A.*
(Continued)

*Primary Examiner* — John R Olszewski
*Assistant Examiner* — Navid Ziaeianmehdizadeh
(74) *Attorney, Agent, or Firm* — Allen, Dyer, Doppelt + Gilchrist, P.A. Attorneys at Law

(57) ABSTRACT

A remote start system for a vehicle having an engine, and a vehicle data communications bus extending throughout the vehicle may include at least one external temperature sensor coupled to the vehicle data communications bus to sense an external vehicle temperature, and at least one internal temperature sensor coupled to the vehicle data communications bus to sense an internal vehicle temperature. The remote start system may also include a wireless remote control device and a controller coupled to the vehicle data communications bus to start the engine based upon the wireless remote control device and determine an idle time threshold based upon the external temperature. The controller may also stop the engine based upon reaching the idle time threshold or an internal vehicle temperature threshold.

24 Claims, 5 Drawing Sheets

(56) References Cited

U.S. PATENT DOCUMENTS

| | | | | |
|---|---|---|---|---|
| 8,560,124 | B2 * | 10/2013 | Oakes | 700/276 |
| 2004/0111199 | A1 * | 6/2004 | Javaherian | 701/36 |
| 2005/0174219 | A1 * | 8/2005 | Flick | 340/426.13 |
| 2007/0018846 | A1 * | 1/2007 | Taraian | 340/825.69 |
| 2007/0144723 | A1 * | 6/2007 | Aubertin et al. | 165/202 |
| 2008/0117079 | A1 * | 5/2008 | Hassan | 340/901 |
| 2009/0099711 | A1 * | 4/2009 | Matsubara et al. | 701/2 |
| 2010/0030456 | A1 * | 2/2010 | Chominsky et al. | 701/112 |
| 2010/0072290 | A1 * | 3/2010 | Dage | 236/51 |
| 2012/0116608 | A1 * | 5/2012 | Park et al. | 701/2 |
| 2012/0267442 | A1 * | 10/2012 | Choi et al. | 236/51 |
| 2013/0013176 | A1 * | 1/2013 | Bassindale | 701/113 |
| 2013/0184970 | A1 * | 7/2013 | Kanafani | 701/103 |
| 2013/0231848 | A1 * | 9/2013 | Roberts et al. | 701/112 |

OTHER PUBLICATIONS

SAE International, Surface Vehicle Standard, Class B Data Communications Network Interface, SAE J1850, Jul. 1995, pp. 1-52.
SAE International, Surface Vehicle Information Report, Chrysler Sensor and Control (CSC) Bus Multiplexing Network for Class 'A' Applications, SAE J2058, Jul. 1990, pp. 1-21.
Thompson, IEEE Spectrum, The Thick and Thin of Car Cabling, Feb. 1996, pp. 42-45.

* cited by examiner

REMOTE START SYSTEM INCLUDING TEMPERATURE BASED ENGINE STOPPAGE AND RELATED METHODS

FIELD OF THE INVENTION

The present invention relates to the field of vehicle control systems and, more particularly, to a remote function control system and related methods for vehicles.

BACKGROUND OF THE INVENTION

Many vehicles include a security system, remote keyless entry system, and/or remote start system which permit a user to perform a function when away from the vehicle. For example, the security system may be switched between armed and disarmed modes by operation of a small handheld remote transmitter. Similarly, remote keyless entry and remote engine starting features can be similarly performed using a suitable remote transmitter. Typically such transmitters are dedicated and sold as part of the overall remote control system. Such systems can be factory installed or added as aftermarket accessories.

A remote start system may also provide a relatively convenient way for a vehicle user to control an operating temperature of a vehicle, for example, to a desired temperature, by remotely starting the engine. Once the engine has been started, the vehicle's climate control system (i.e., heating and cooling systems) may moderate the vehicle cabin temperature to a preset temperature that is comfortable to the user.

Additionally, remote start system may provide a more convenient way for a user to also raise the engine operating temperature and engine component temperatures, such as oil and other engine fluids, for example, in preparation of vehicle movement. This may be particularly advantageous in cold environmental conditions.

However, in some remote start situations the engine of the vehicle may be permitted to idle despite the desired engine and cabin temperatures having been reached. At this point fuel is unnecessarily consumed and excess pollution is generated.

Several references disclose stopping an engine of a vehicle after a threshold time period. More particularly, U.S. Pat. No. 4,381,042 to Perry discloses starting a timer if either an emergency brake switch or seat switch closes while the engine is operating. If the timer expires before either the emergency brake switch or seat switch opens, the engine is stopped.

U.S. Pat. No. 5,219,413 discloses stopping an engine when an engine is left idling unattended for a threshold time period. The vehicle is determined to be unattended via a motion detector. Temperature sensors may be used to determine whether the vehicle is moving prior to stopping the engine.

U.S. Pat. No. 7,310,576 to Letang discloses stopping a vehicle engine when an idle time threshold is exceeded. The idle time threshold is set based upon a geographical location of the vehicle.

Further improvements to remote start systems with respect to idle time may be desired. More particularly, it may be desirable to more efficiently control idle time thresholds in a remote start system, for example, to improve fuel efficiency and comply with environmental policies.

SUMMARY OF THE INVENTION

In view of the foregoing background, it is therefore an object of the present invention to provide remote start system that is more efficient with respect to engine idle time.

This and other objects, features, and advantages in accordance with the present invention are provided by a remote start system for a vehicle having an engine and a vehicle data communications bus extending throughout the vehicle may include at least one external temperature sensor coupled to the vehicle data communications bus to sense an external vehicle temperature, and at least one internal temperature sensor coupled to the vehicle data communications bus to sense an internal vehicle temperature. The remote start system may also include a wireless remote control device, and a remote start controller coupled to the vehicle data communications bus. The remote start controller is to start the engine based upon the wireless remote control device and determine an idle time threshold based upon the external vehicle temperature. The controller may also stop the engine based upon reaching the idle time threshold or an internal vehicle temperature threshold. Accordingly, the remote start system more efficiently operates a vehicle's engine, for example, by stopping the engine based upon an idle time threshold determined by an external temperature, or based upon an internal temperature.

The remote start controller may be configured to stop the engine based upon reaching a first one of the idle time threshold or the internal vehicle temperature threshold. The remote start controller may be configured to stop the engine based upon reaching a threshold temperature difference between the interior vehicle temperature and the exterior vehicle temperature, for example.

The remote start controller may be to set the idle time threshold to between 10 and 15 minutes when the external temperature is below a threshold, for example. The remote start controller may also be to set the idle time threshold to between 0.5 and 3 minutes when the external temperature is within a predetermined range, for example. The remote start controller may further be to set the idle time threshold to between 3 and 10 minutes when the external temperature is greater than a threshold, for example. The remote start controller may be to prevent a start of the engine based upon the wireless remote control device when the external temperature is within a predetermined range.

The at least one internal temperature sensor may include at least one internal temperature sensor to sense a passenger cabin temperature. The at least one internal temperature sensor may also include at least one internal temperature sensor to sense a temperature of the engine, for example. The at least one internal temperature sensor may include a plurality thereof for sensing an internal vehicle temperature based upon a temperature of a passenger cabin of the vehicle and a temperature of the engine.

A method aspect is directed to a method of remote control operation of an engine of a vehicle that includes a vehicle data communications bus extending throughout the vehicle. The method may include starting the engine based upon a wireless remote control device, and determining an idle time threshold based upon an external vehicle temperature sensed from at least one external temperature sensor coupled to the vehicle data communications bus. The method may also include stopping the engine based upon reaching the idle time threshold or an internal vehicle temperature threshold based upon an internal vehicle temperature sensed from at least one internal temperature sensor coupled to the vehicle data communications bus.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

Figure 1:
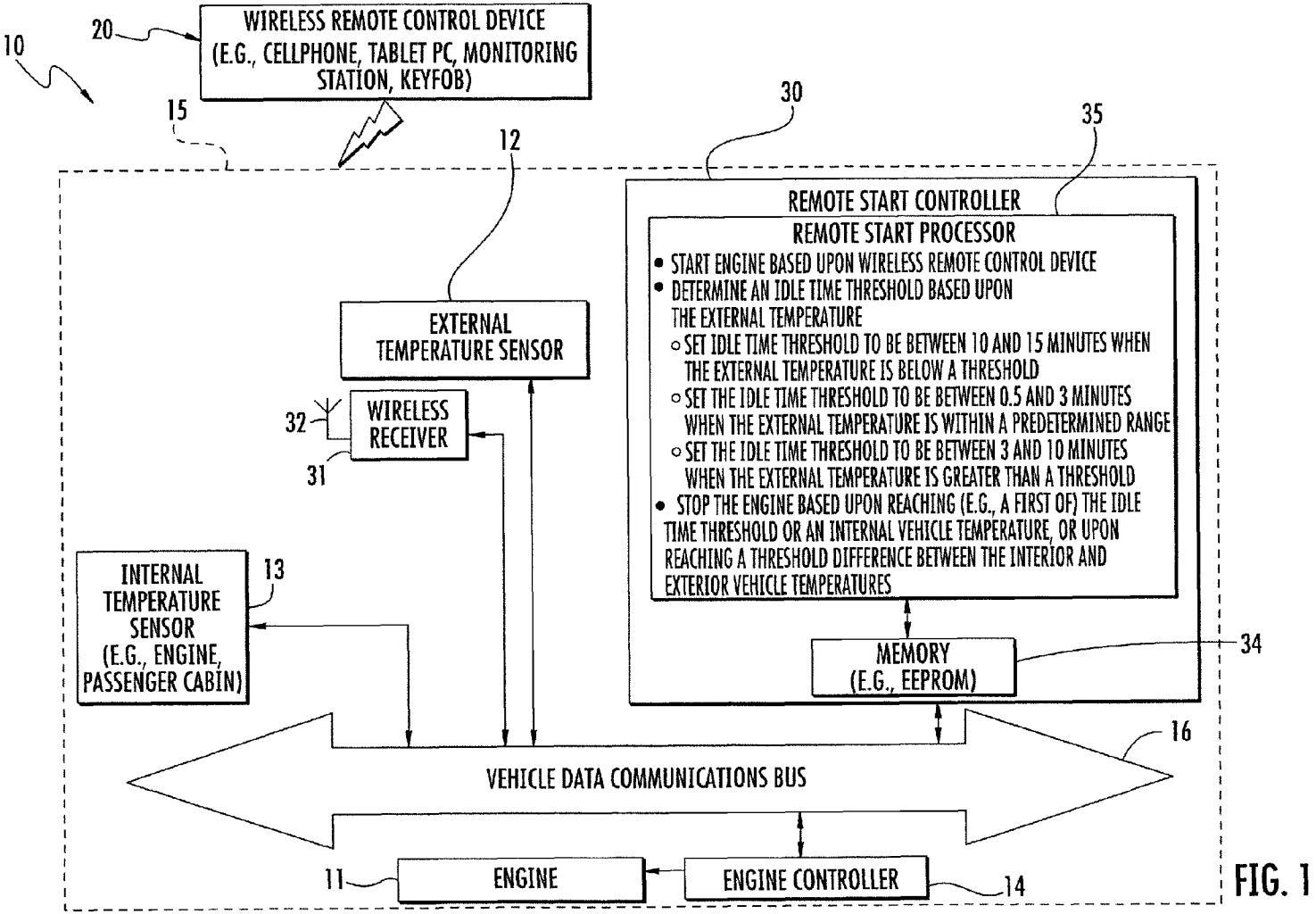
FIG. 1 is a block diagram of a remote start system in accordance with the present invention.

Referring initially to FIG. 1, a remote start system 10 for a vehicle 15 having an engine 11 and a vehicle data communications bus 16 extending throughout the vehicle is described. The vehicle data communication bus 16 may be a Controller Area Network bus (CAN-bus) vehicle data bus, for example. Of course, the vehicle data communications bus 16 may be another type of bus, as will be appreciated by those skilled in the art.

The remote start system 10 includes an external temperature sensor 12 coupled to the vehicle data communications bus 16 to sense an external vehicle temperature and an internal temperature sensor 13 also coupled to the vehicle data communications bus to sense an internal vehicle temperature. The external temperature sensor 12 may be carried by the vehicle 15 at a location where the temperature may be read with a reduced influence from any heat that may be generated from the engine 11. The internal temperature sensor 13 may be a thermostat, for example. The internal temperature sensor 13 may sense a passenger cabin temperature, or the internal temperature sensor may sense a temperature of the engine 11. Of course, the internal temperature sensor 13 may sense another internal temperature, for example. Either or both of the external temperature sensor 12 and internal temperature sensor 13 may be coupled to the data bus 16 via one or more intervening controllers, not shown, as would be understood by those skilled in the art.

The sensed vehicle temperatures (internal and external) may be sensed periodically or continuously. This may advantageously increase accuracy of the sensed vehicle temperatures, and may reduce errors associated with incorrect sensed temperatures. For example, ten vehicle temperature readings may be sensed per second. Of course, the sensed vehicle temperatures may be sensed at different intervals.

The remote start system 10 also includes a wireless remote control device 20, remote from the vehicle 15, and a remote start controller 30 at the vehicle to start the engine 11 based upon the wireless remote control device. More particularly, based upon the wireless remote control device 20, the remote start controller 30 cooperates to activate an engine controller 14 of the vehicle 15, which in turn, starts the engine 11.

The remote start controller 30 is coupled to the vehicle data communications bus 16. In some embodiments, the remote start controller 30 may be wirelessly coupled to the vehicle data communications bus 16, for example, as disclosed in application Ser. No. 13/826,752 to Flick, filed Mar. 14, 2013, and the entire contents of which are herein incorporated by reference. The engine controller 14 is also coupled to the vehicle data communications bus 16.

The engine controller 14 may include an engine control module (ECM) which, in turn, may control the starter, fuel pump, and/or other devices or circuitry for controlling starting, running, and shut down of the engine 11. The remote start controller 30 illustrated includes a remote start processor 35 and a memory 34 coupled thereto. It should be understood that the functionality of the remote start controller 30 described herein is performed by cooperation between the remote start processor 35 and the memory 34. Of course, the remote start controller 30 can be implemented by circuitry in multiple vehicle components.

The wireless remote control device 20 may be a cellphone, tablet PC, keyfob, or a remote monitoring station, for example. More particularly, the wireless remote control device 20 may be any device remote from the vehicle that is configured to wirelessly send an engine start command or remotely start the engine 11 of the vehicle 15. The remote control device 20 may wirelessly start the engine 11, for example, via radio frequency (RF), satellite, microwave, infrared, or other type of wireless communications protocol.

Figure 2:
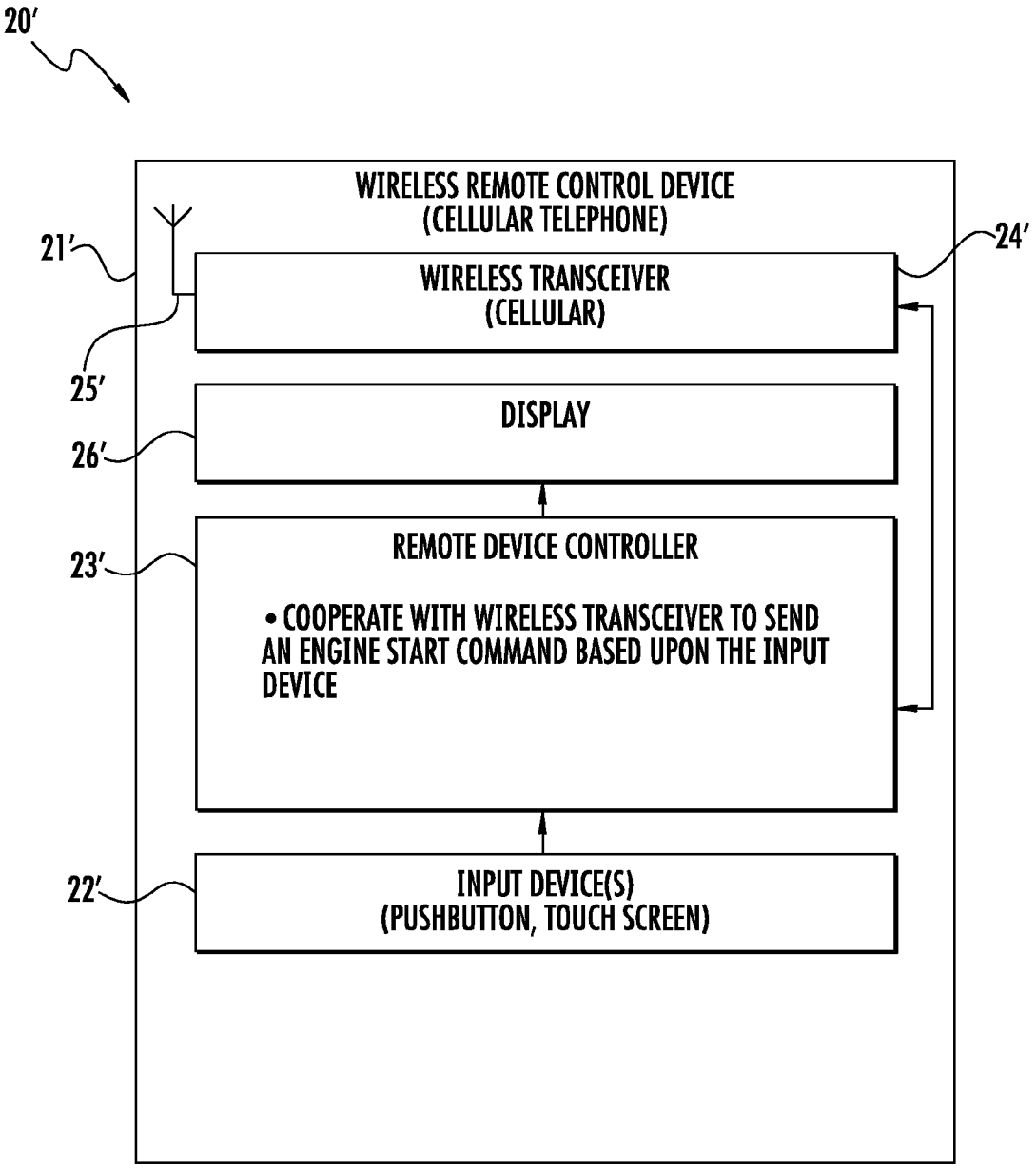
FIG. 2 is a schematic block diagram of an example wireless remote control device for use with a remote start system according to an embodiment of the present invention.

Referring now to FIG. 2, in one embodiment, the wireless remote control device 20' is a cellular telephone and includes a housing 21', input devices 22' (e.g. pushbuttons and/or touchscreen) carried by the housing, and a remote device controller 23' carried by housing and coupled to the input devices. A display 26' is also carried by the housing 21' and coupled to the remote device controller 23'. A wireless transceiver 24' is coupled to the remote device controller 23'. An antenna 25' is coupled to the wireless transceiver 24'. The remote device controller 23' cooperates with the wireless transceiver 24' to wirelessly send an engine operation signal based upon one of the input devices 22'. The engine operation signal may be a vehicle start signal, for example.

Referring again to FIG. 1, a wireless receiver 31 and antenna 32 are included within the vehicle 15, and the wireless receiver is coupled to the remote start controller 30 via the vehicle data communications bus 16. The wireless receiver 31 receives the engine operation signal from the wireless remote control device 20 and cooperates with the remote start controller 30 to operate the engine controller 14 to thus start the engine 11.

In some embodiments, the remote start controller 30 may cooperate with the wireless receiver 31 to authenticate commands received from the wireless remote control device 20. For example, the remote start controller 30 may communicate with the wireless remote control device 20 using an encrypted protocol or communication.

The remote start controller 30 also determines an idle time threshold based upon the external temperature. For example, the remote start controller 30 may determine the idle time threshold based upon a look-up table stored in a memory 34, for example, an erasable programmable read-only memory (EEPROM). In one example, the remote start controller 30 may set the idle time threshold to be between 10 and 15 minutes when the external temperature is greater than a threshold temperature. The remote start controller 30 may also set the idle time threshold to be between 0.5 and 3 minutes when the external temperature is in a predetermined temperature range, for example, between −10° C. and 35° C., and to be between 3 and 10 minutes when the external temperature is greater than a threshold temperature, for example, 35° C. Of course, other idle time thresholds may be set based upon the external temperature, as will be appreciated by those skilled in the art. For example, idle time thresholds may be based upon local environmental policies enacted in a geographical area of operation of the vehicle 15, and/or user preferences. In some embodiments the temperature ranges and corresponding thresholds may be modified and programmed after installation of the remote start system 10.

The remote start controller 30 stops the engine based upon reaching the idle time threshold or an internal vehicle temperature threshold. More particularly, the remote start controller 30 is configured to stop the engine 11 based upon reaching a first one of the idle time threshold and the internal vehicle temperature threshold. In other words, during the idle time, the remote start controller 30 monitors the internal temperature sensor 13 to determine if the threshold internal temperature has been reached. Should the internal temperature reach the threshold internal temperature before reaching the idle time threshold, the remote start controller 30 stops the engine 11, for example, by generating a stop engine command, which may stop the fuel supply or ignition to the engine, as will be appreciated by those skilled in the art. The remote start controller 30 also stops the engine 11 based upon reaching a threshold temperature difference between the interior vehicle temperature and the exterior vehicle temperature. Of course, in some embodiments, the remote start controller 30 may not stop the engine based upon reaching the first of the idle time threshold and the internal vehicle threshold.

Figure 3:
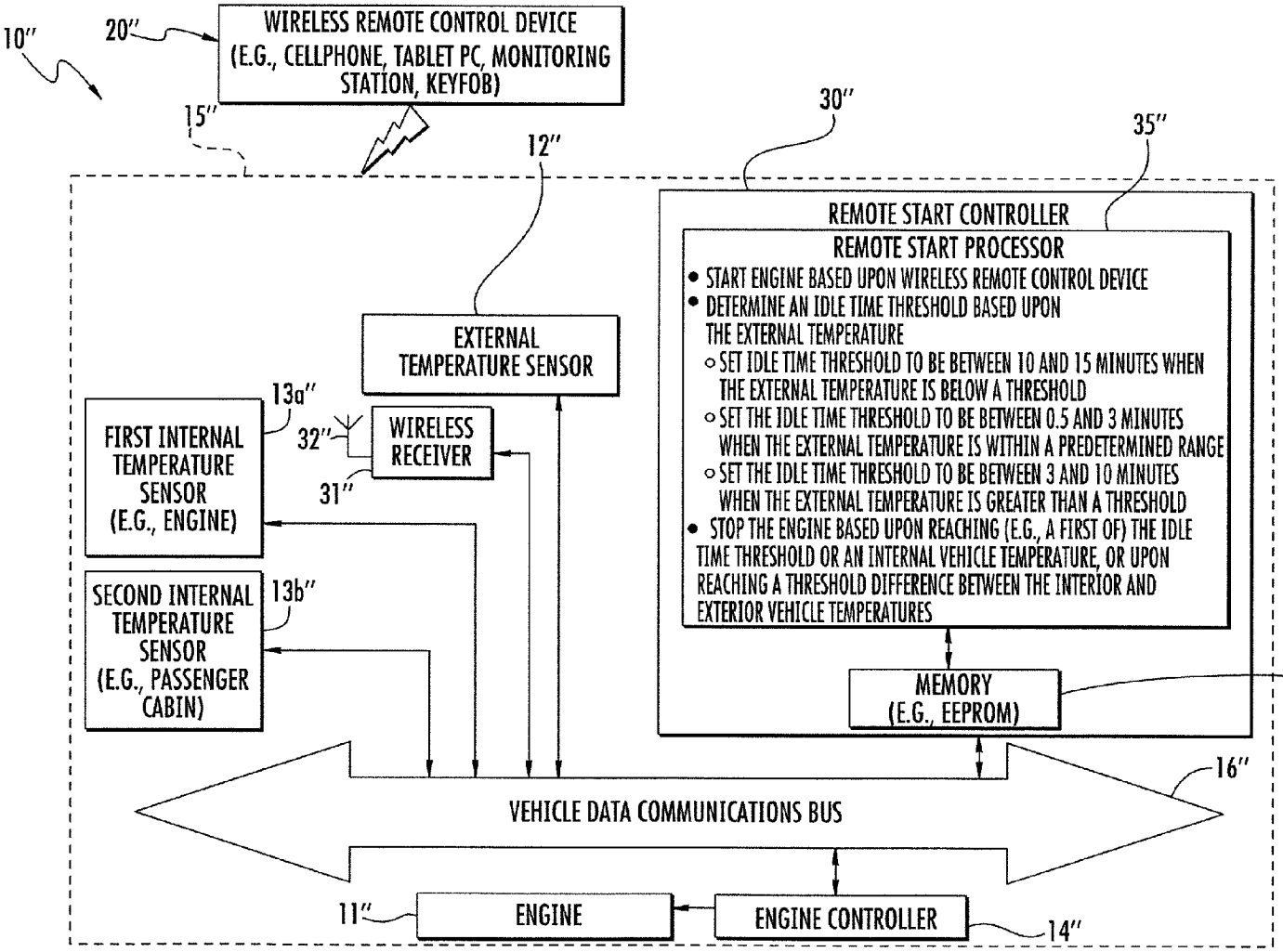
FIG. 3 is a block diagram of a remote start system in accordance with another embodiment of the present invention.

Referring now to FIG. 3, in another embodiment, the vehicle 15" includes a first internal temperature sensor 13*a*" for sensing a temperature of the passenger cabin, and a second internal temperature sensor 13*b*" for sensing a temperature of the engine 11". The remote start controller 30" may stop the engine 11" based upon an internal vehicle temperature threshold that may be independently based upon either of the first and second internal temperatures, or an average of the first and second internal temperatures. Of course the internal vehicle temperature threshold may be based upon any relationship between the first and second internal temperatures.

Figure 4:
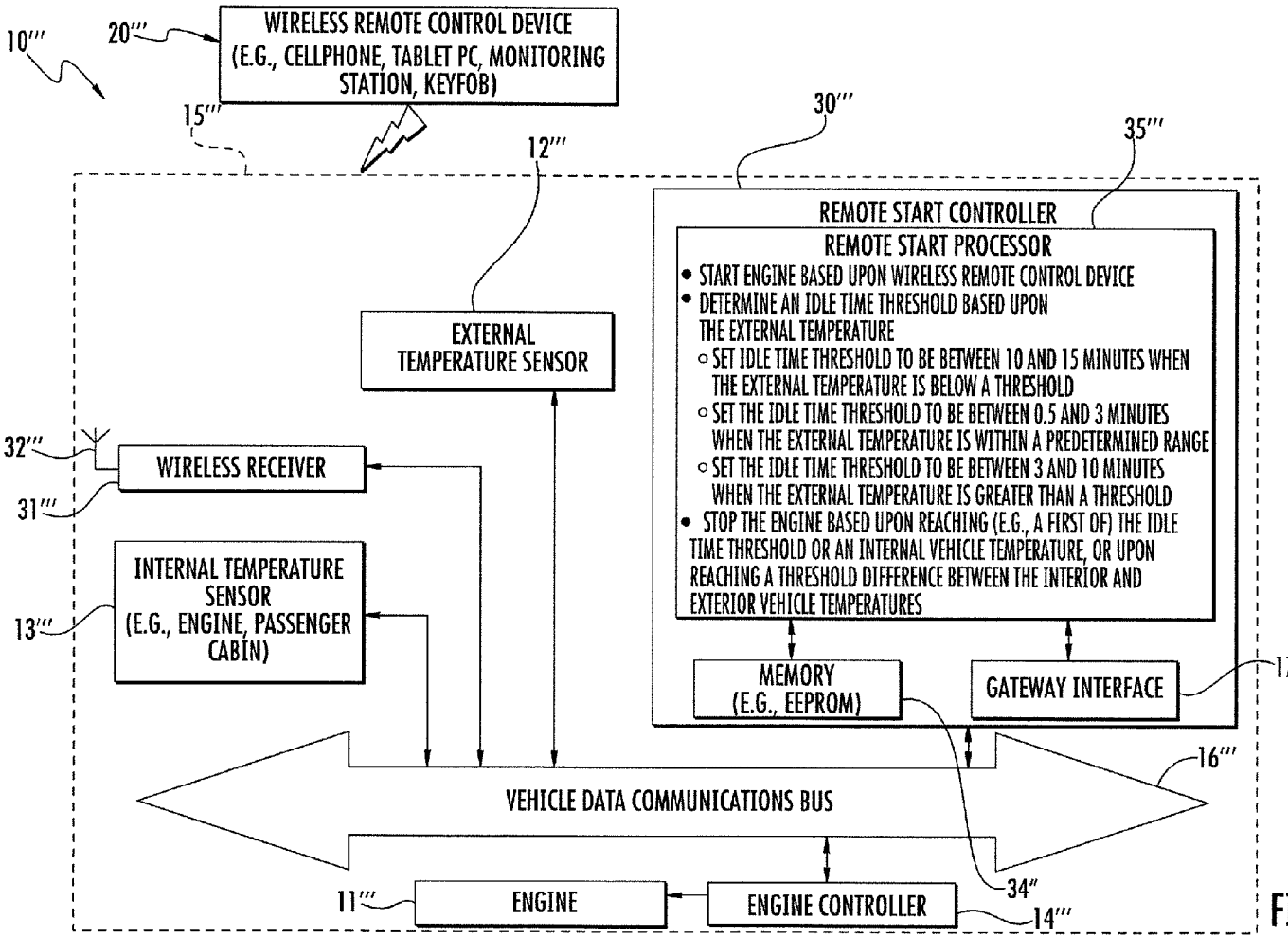
FIG. 4 is a block diagram of a remote start system in accordance with yet another embodiment of the present invention.

Referring now to FIG. 4, in yet another embodiment, a gateway interface 17''' may be coupled between the vehicle data communications bus and the remote start controller. The gateway interface 17''' may permit communication, for example, digital communication, with vehicle devices via data lines of the vehicle data communications bus 16'''. Communications over the vehicle data communications bus 16''' may be encrypted, as will be appreciated by those skilled in the art.

Additionally, the remote start controller 30''' may be a multi-vehicle compatible remote start controller that is operable with different vehicles using different data bus protocols and/or different vehicle device bus codes. As will be appreciated by those skilled in the art, the vehicle device bus codes may be unique to each vehicle or vehicle manufacturer. In some embodiments, the different data bus codes and/or data bus protocols may be stored in a memory coupled to the multi-vehicle compatible remote start controller. Further details regarding a multi-vehicle compatible controller are disclosed in U.S. Pat. Nos. 5,719,551 and 6,011,460 to Flick, for example, and application Ser. No. 13/826,752, filed Mar. 14, 2013, the entire contents of all of which are herein incorporated in their entirety by reference.

Moreover, it will be appreciated by those skilled in the art, that other and/or additional vehicle devices may be coupled to the vehicle data communications bus 16''' within the vehicle 15'''. For example, such vehicle devices may be sensors or controllers as disclosed in U.S. Pat. Nos. 5,719,551 and 6,011,460 to Flick.

While the remote start controller 30 has been described with respect to remotely starting an engine 11, it will be appreciated that the remote start controller may additionally operate other vehicle devices, for example, door locks, windows, etc. based upon the wireless remote control device 20.

Advantageously, the remote start system 10 may increase fuel conservation, reduce emissions, and aid in compliance with local engine idling policies by setting the engine idle times based on the exterior temperature of the vehicle, and based upon an operating temperature of an interior of the vehicle, an engine temperature, or any combination thereof, for example. Additionally, the remote vehicle start system 10 may also provide increased security or safety as the remote start controller 30 may prevent the start of the engine 11 when the external temperature is within a particular range, for example, that may coincide with a temperature range within a garage or enclosed space. By preventing the start of the engine 11, build-up of carbon monoxide within an enclosed garage or space may be reduced, for example, if the engine should be inadvertently started based upon the wireless remote control device 20.

For example, with respect to engine idling policies, idling of a vehicle for longer periods may be allowed during colder temperatures while longer idling times during warmer temperatures may not be allowed. While prior art systems may stop the engine after a threshold time period, the user would have to manually adjust these different idle times based on vehicle temperature ranges. Still, while such engine stoppages may be set to occur based upon the threshold idling times prescribed by policy, it may be possible that desired vehicle operating temperature thresholds may have been reached before the threshold idling times, which may lead to needlessly consumed fuel and increased pollution. The remote start system 10 advantageously addresses these shortcomings by determining the idle time threshold based upon the external temperature and stopping the engine 11 based upon reaching the idle time threshold or an internal vehicle temperature threshold.

Figure 5:
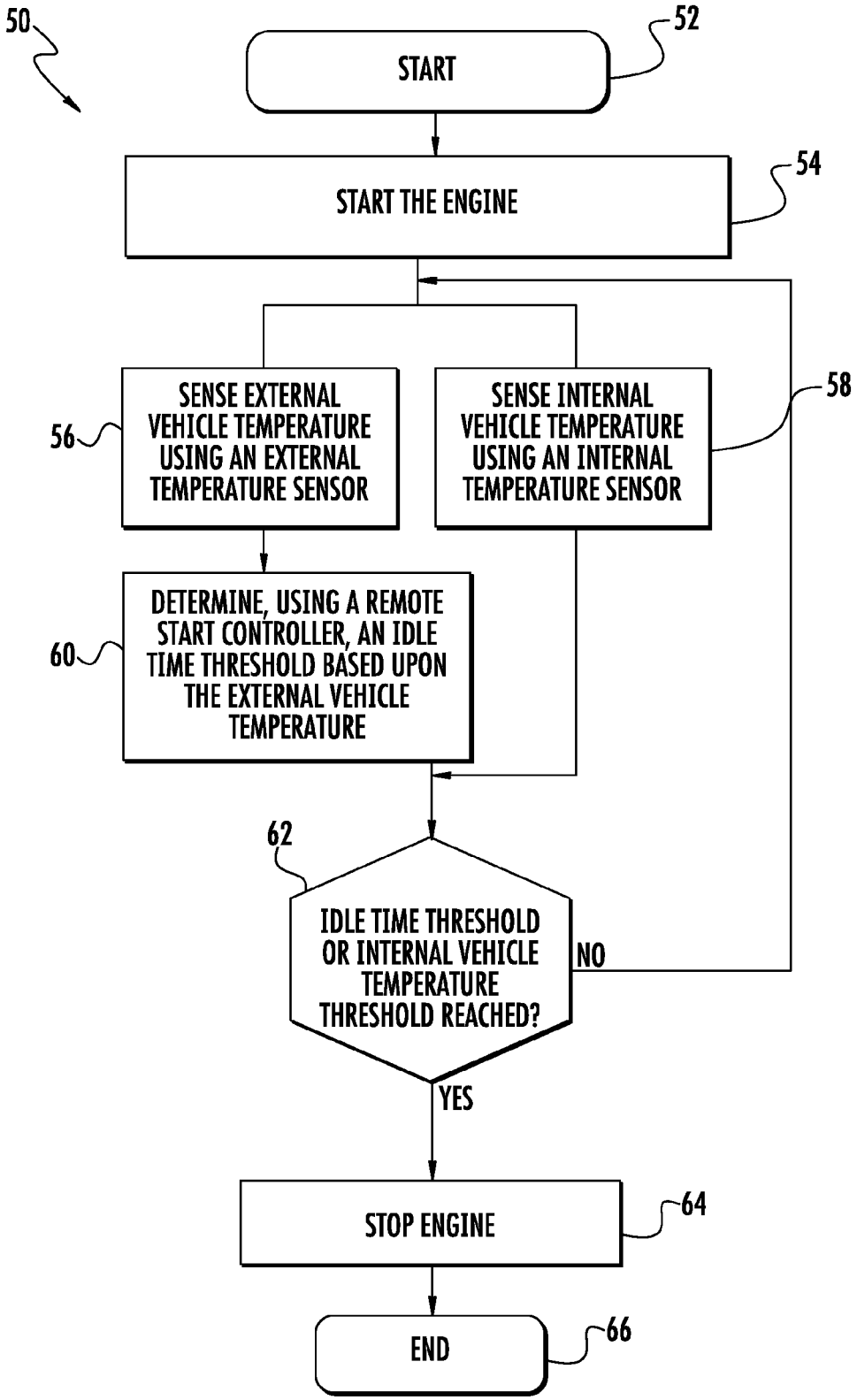
FIG. 5 is a flowchart of a method of remote control operation of an engine according to the present invention.

Referring now to the flowchart 50 in FIG. 5, a method of remote control operation of an engine 11 of a vehicle 15 having a vehicle communications data bus 16 extending throughout the vehicle is described. Beginning at Block 52, the method includes starting the engine 11 based upon the wireless remote control device 20 (Block 54). At Block 56, the method includes, sensing an external vehicle temperature with an external temperature sensor 12 coupled to the vehicle data communications bus 16 and that may be external to the vehicle 15. An internal vehicle temperature is sensed at Block 58 using an internal temperature sensor 13 coupled to the vehicle data communications bus 16. At Block 60, the method includes determining, by using a remote start controller 30, an idle time threshold based upon the external vehicle temperature sensed from the external temperature sensor 12. At Block 62 if it determined that the idle time threshold or an internal vehicle temperature threshold has been reached, the engine 11 is stopped at Block 64. Otherwise, if it determined that the idle time threshold or an internal vehicle temperature threshold has not been reached, the engine 11 continues to idle and the external and internal vehicle temperatures are again sensed (Blocks 56 and 58). The method ends at Block 66.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A remote start system for a vehicle having an engine and a vehicle data communications bus extending throughout the vehicle, the remote start system comprising:

at least one external temperature sensor coupled to the vehicle data communications bus to sense an external vehicle temperature;

at least one internal temperature sensor coupled to the vehicle data communications bus to sense an internal vehicle temperature;

a wireless remote control device; and a remote start controller coupled to the vehicle data communications bus to start the engine based upon the wireless remote control device, determine an idle time threshold based upon the external temperature, and stop the engine based upon reaching the idle time threshold or an internal vehicle temperature threshold.

2. The system of claim 1, wherein said remote start controller is configured to stop the engine based upon reaching a first one of the idle time threshold or the internal vehicle temperature threshold.

3. The system of claim 1, wherein said remote start controller is configured to stop the engine based upon reaching a threshold temperature difference between the interior vehicle temperature and the exterior vehicle temperature.

4. The system of claim 1, wherein said remote start controller is to set the idle time threshold to between 10 and 15 minutes when the external temperature is below a threshold.

5. The system of claim 1, wherein said remote start controller is to set the idle time threshold to between 0.5 and 3 minutes when the external temperature is within a predetermined range.

6. The system of claim 1, wherein said remote start controller is to set the idle time threshold to between 3 and 10 minutes when the external temperature is greater than a threshold.

7. The system of claim 1, wherein said remote start controller is to prevent a start of the engine based upon the wireless remote control device when the external temperature is within a predetermined range.

8. The system of claim 1, wherein said at least one internal temperature sensor comprises at least one internal temperature sensor to sense a passenger cabin temperature.

9. The system of claim 1, wherein said at least one internal temperature sensor comprises at least one internal temperature sensor to sense a temperature of the engine.

10. The system of claim 1, wherein said at least one internal temperature sensor comprises a plurality thereof for sensing an internal vehicle temperature based upon a temperature of a passenger cabin of the vehicle and a temperature of the engine.

11. A remote start controller for a vehicle having an engine, a vehicle data communications bus extending throughout the vehicle, at least one external temperature sensor coupled to the vehicle data communications bus to sense an external temperature, and at least one internal temperature sensor coupled to the vehicle data communications bus to sense an internal vehicle temperature, the remote start controller comprising:

a processor and memory cooperating therewith and coupled to the vehicle data communications bus to start the engine based upon a wireless remote control device, determine an idle time threshold based upon the external temperature, and stop the engine based upon reaching the idle time threshold or an internal vehicle temperature threshold.

12. The remote start controller of claim 11, wherein said processor and memory cooperate to stop the engine based upon reaching a first one of the idle time threshold or the internal vehicle temperature threshold.

13. The remote start controller of claim 11, wherein said processor and memory cooperate to stop the engine based upon reaching a threshold temperature difference between the interior vehicle temperature and the exterior vehicle temperature.

14. The remote start controller of claim 11, wherein said processor and memory cooperate to set the idle time threshold to between 10 and 15 minutes when the external temperature is below a threshold.

15. The remote start controller of claim 11, wherein said processor and memory cooperate to set the idle time threshold to between 0.5 and 3 minutes when the external temperature is within a predetermined range.

16. The remote start controller of claim 11, wherein said processor and memory cooperate to set the idle time threshold to between 3 and 10 minutes when the external temperature is greater than a threshold.

17. The remote start controller of claim 11, wherein said processor and memory cooperate to prevent a start of the engine based upon the wireless remote control device when the external temperature is within a predetermined range.

18. A method of remote control operation of an engine of a vehicle having a vehicle data communications bus extending throughout the vehicle, the method comprising:

starting the engine based upon a wireless remote control device;

determining an idle time threshold based upon an external vehicle temperature sensed from at least one external temperature sensor coupled to the vehicle data communications bus; and stopping the engine based upon reaching the idle time threshold or an internal vehicle temperature threshold based upon an internal vehicle temperature sensed from at least one internal temperature sensor coupled to the vehicle data communications bus.

19. The method of claim 18, wherein stopping the engine is based upon reaching a first one of the idle time threshold or the internal vehicle temperature threshold.

20. The method of claim 18, wherein stopping the engine is based upon reaching a threshold temperature difference between the interior vehicle temperature and the exterior vehicle temperature.

21. The method of claim 18, further comprising setting the idle time threshold to between 10 and 15 minutes when the external temperature is below a threshold.

22. The method of claim 18, further comprising setting the idle time threshold to between 0.5 and 3 minutes when the external temperature is within a predetermined range.

23. The method of claim 18, further comprising setting the idle time threshold to between 3 and 10 minutes when the external temperature is greater than a threshold.

24. The method of claim 18, further comprising preventing a start of the engine based upon the wireless remote control device when the external temperature is within a predetermined range.

* * * * *